US012791239B2

(12) United States Patent
Taras

(10) Patent No.: US 12,791,239 B2
(45) Date of Patent: Nov. 10, 2026

(54) HEATING, VENTILATION, AND AIR-CONDITIONING SYSTEM WITH A THERMAL ENERGY STORAGE DEVICE

(71) Applicant: Goodman Global Group, Inc., Waller, TX (US)

(72) Inventor: Michael F. Taras, The Woodlands, TX (US)

(73) Assignee: Goodman Global Group, Inc., Waller, TX (US)

( * ) Notice: Subject to any disclaimer, the term of this patent is extended or adjusted under 35 U.S.C. 154(b) by 0 days.

(21) Appl. No.: 17/321,037

(22) Filed: May 14, 2021

(65) Prior Publication Data

US 2021/0364208 A1 Nov. 25, 2021

Related U.S. Application Data

(60) Provisional application No. 63/027,459, filed on May 20, 2020.

(51) Int. Cl.
*F25B 49/02* (2006.01)
*F25B 39/00* (2006.01)
*F25B 41/31* (2021.01)

(52) U.S. Cl.
CPC ..... *F25B 49/02* (2013.01); *F25B 39/00* (2013.01); *F25B 41/31* (2021.01); (Continued)

(58) Field of Classification Search
CPC ..... F25B 49/02; F25B 41/31; F25B 39/00; F25B 2600/2513; F25B 2600/2501; (Continued)

(56) References Cited

U.S. PATENT DOCUMENTS 5,680,898 A * 10/1997 Rafalovich ..... F25B 13/00 165/236
9,903,621 B1 * 2/2018 Goel ..... F25B 9/008
(Continued)

FOREIGN PATENT DOCUMENTS

CA 2775255 A1 * 3/2011 ..... F28D 15/043
ES 2746562 T3 * 3/2020 ..... F24F 11/89
(Continued)

OTHER PUBLICATIONS

ES-2746562-T3 English Translation (Year: 2020).*
(Continued)

*Primary Examiner* — Frantz F Jules
*Assistant Examiner* — Devon Moore

(57) ABSTRACT

A heating, ventilation, and air-conditioning ("HVAC") system for use with a refrigerant. The HVAC system includes a compressor, a condenser, an evaporator expansion device, and an evaporator. The HVAC system also includes a thermal energy storage device ("TESD") including thermal energy storage media in line between the condenser and evaporator. A control system is programmed to operate the compressor and the evaporator expansion device to control the refrigerant flow through the HVAC system. The control system is also programmed to control the refrigerant flow through the TESD to charge the TESD with thermal energy. The control system is also programmed to control the refrigerant flow through the evaporator expansion device and evaporator and discharge the thermal energy from the charged TESD to improve the performance of the HVAC system.

3 Claims, 8 Drawing Sheets

(52) U.S. Cl.
CPC ..... *F25B 2400/0409* (2013.01); *F25B 2400/0411* (2013.01); *F25B 2400/24* (2013.01); *F25B 2600/2501* (2013.01); *F25B 2600/2513* (2013.01)

(58) Field of Classification Search
CPC ..... F25B 2400/0409; F25B 2400/0411; F25B 2400/24; F25B 25/005; F24F 5/0017; F24F 5/0021
See application file for complete search history.

(56) References Cited

U.S. PATENT DOCUMENTS

| | | | | |
|---|---|---|---|---|
| 2014/0338389 | A1 | 11/2014 | Ma et al. | |
| 2016/0076821 | A1* | 3/2016 | Kopko | F28D 20/0039 165/10 |
| 2018/0283709 | A1 | 10/2018 | Al-Hallaj | |
| 2018/0340738 | A1* | 11/2018 | Kozubal | F28D 7/0025 |
| 2019/0003782 | A1 | 1/2019 | Singh et al. | |
| 2021/0356182 | A1* | 11/2021 | Al-Hallaj | F25B 41/31 |

FOREIGN PATENT DOCUMENTS

| | | | | | |
|---|---|---|---|---|---|
| KR | 10-2013-0067383 | A | | 6/2013 | |
| KR | 10-2013-0081396 | A | | 7/2013 | |
| KR | 20130081396 | A | * | 7/2013 | F25B 41/06 |
| WO | WO-9600370 | A1 | * | 1/1996 | F24D 11/0214 |
| WO | WO-9724565 | A1 | * | 7/1997 | F25B 13/00 |
| WO | WO-2012135470 | A1 | * | 10/2012 | F25B 1/00 |
| WO | WO-2016077281 | A1 | * | 5/2016 | F25B 25/005 |

OTHER PUBLICATIONS

KR-20130081396-A English Translation (Year: 2013).*
International Search Report and Written Opinion mailed Aug. 27, 2021 for corresponding PCT Application No. PCT/US2021/032765 filed on May 17, 2021.

* cited by examiner

HEATING, VENTILATION, AND AIR-CONDITIONING SYSTEM WITH A THERMAL ENERGY STORAGE DEVICE

BACKGROUND

This section is intended to introduce the reader to various aspects of the art that may be related to various aspects of the presently described embodiments to help facilitate a better understanding of various aspects of the present embodiments. Accordingly, it should be understood that these statements are to be read in this light, and not as admissions of prior art.

In general, heating, ventilation, and air-conditioning ("HVAC") systems circulate an indoor space's air over low-temperature (for cooling) or high-temperature (for heating) sources, thereby adjusting an indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop of tubing that uses a compressor and flow-control devices to manipulate the refrigerant's flow and pressure, causing the refrigerant to cycle between the liquid and gas phases. Generally, these phase transitions occur within the HVAC system heat exchangers, which are part of the closed loop and designed to transfer heat between the circulating refrigerant and flowing ambient air. As would be expected, the heat exchanger providing heating or cooling to the climate-controlled space or structure is described adjectivally as being "indoors," and the heat exchanger transferring heat with the surrounding outdoor environment is described as being "outdoors."

The refrigerant circulating between the indoor and outdoor heat exchangers transitioning between phases along the way absorbs heat from one location and releases it to the other. Those in the HVAC industry describe this cycle of absorbing and releasing heat as "pumping," To cool the climate-controlled indoor space, heat is "pumped" from the indoor side to the outdoor side, and the indoor space is heated by doing the opposite, pumping heat from the outdoors to the indoors.

Another type of HVAC system is a thermal energy storage (TES) system. TESs shift cooling energy use to non-peak times, thus shifting the load on the HVAC system. They chill storage media such as water, ice, or a phase-change material during periods of low cooling demand for use later to meet air-conditioning loads and to reduce the stress on the power grid. Operating strategies are generally classified as either full storage or partial storage, referring to the amount of cooling load transferred from on-peak to off-peak.

In a TES system, a storage medium is chilled during periods of low cooling demand, and the stored cooling is used later to meet air-conditioning load or process cooling loads. The system consists of a storage medium in a tank, a packaged chiller or built-up refrigeration system, and interconnecting piping, pumps, and controls. The storage medium is generally water, ice, or a phase-change material (sometimes called a eutectic salt); it is typically chilled to lower temperatures than would be required for direct cooling to keep the storage tank size within economic limits.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The present disclosure can relate to a packaged air conditioning system, a heat pump, a chiller or a close-coupled split system. Also, the disclosure can be related to district cooling, supermarket refrigeration or other distributed systems. The system includes a thermal energy storage device ("TESD") including thermal energy storage media in line between a condenser and an evaporator. A control system is programmed to operate the compressor and an evaporator expansion device to control the refrigerant flow through the HVAC system. The control system is also programmed to charge the TESD with thermal energy and control the refrigerant flow through the evaporator expansion device and evaporator and discharge the thermal energy from the charged TESD so as to improve the performance of the HVAC system. Performance can be considered as the heating or cooling capacity provided by the HVAC system per unit of power consumption. Examples include EER (energy efficiency ratio) in cooling and COP (coefficient of performance) in heating. Advantageously, certain disclosed embodiments may provide system performance improvements, lower operating cost, unit size reduction, and flexibility in meeting the conditioned space thermal load demands.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
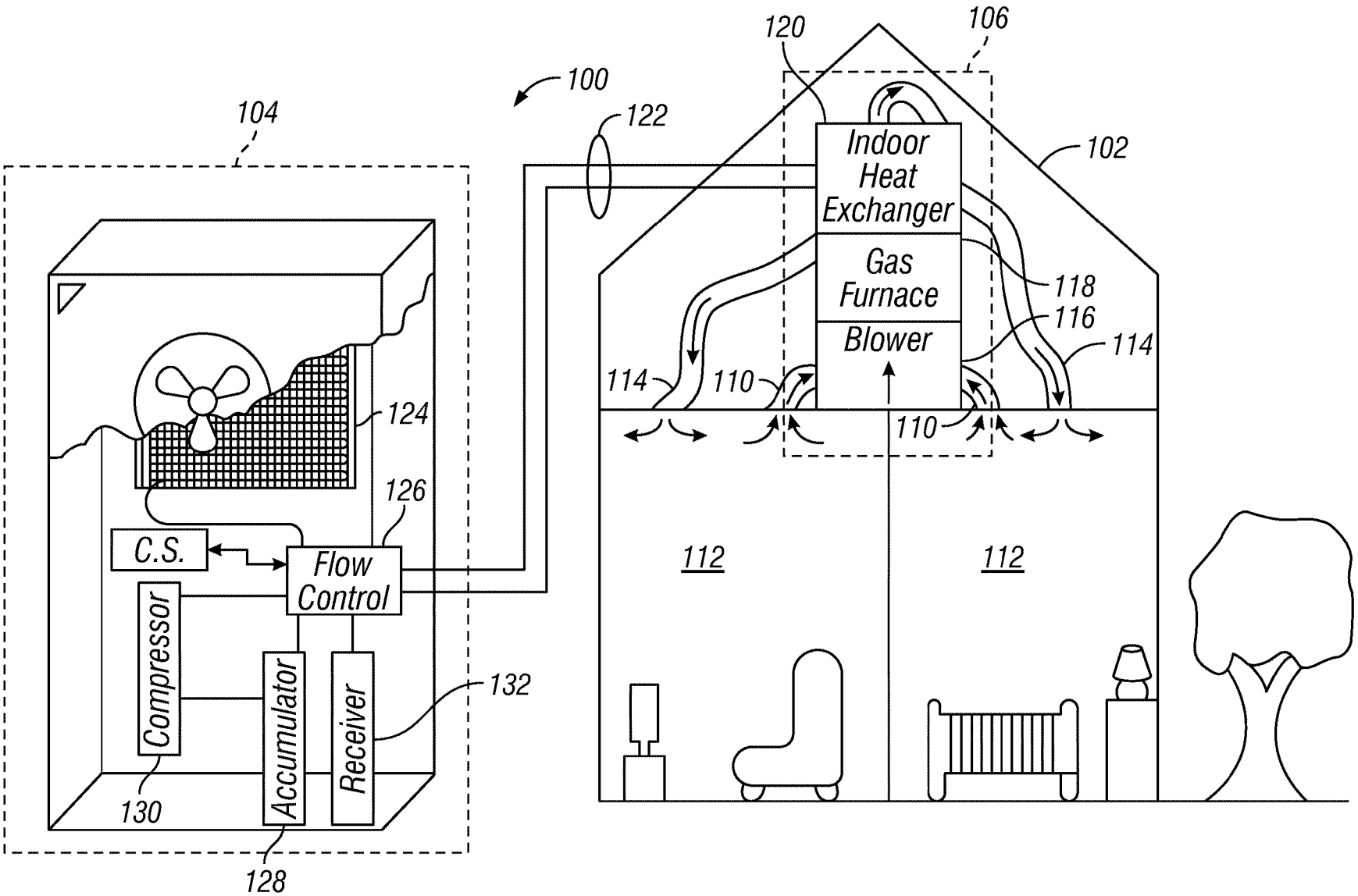
FIG. 1 is a block diagram of an HVAC system, according to one or more embodiments.

Turning now the figures, FIG. 1 illustrates a schematic of an HVAC system 100. As depicted, the HVAC system 100 heats and cools a residential structure 102. However, the concepts disclosed herein are applicable to numerous of heating and cooling situations, which include industrial and commercial settings.

The HVAC system 100 divides into two primary portions: The outdoor unit 104, which comprises components for transferring heat with the environment outside the structure 102; and the indoor unit 106, which comprises components for transferring heat with the air inside the structure 102. To heat or cool the illustrated structure 102, the indoor unit 106 draws indoor air via returns 110, passes that air over one or more heating/cooling elements sources of heating or cooling), and then routes that conditioned air, whether heated or cooled, back to the various climate-controlled spaces 112 through ducts or ductworks 114 which are relatively large pipes that may be rigid or flexible. A blower 116 provides the motivational force to circulate the ambient air through the returns 110 and the ducts 114. Additionally, although a split system is shown in FIG. 1, the disclosed embodiments can be equally applied to the packaged or other types of system configurations.

As shown, the HVAC system 100 is a "dual-fuel" system that has multiple heating elements, such as an electric heating element or a gas furnace 118. The gas furnace 118 located downstream (in relation to airflow) of the blower 116 combusts natural gas to produce heat in furnace tubes (not shown) that coil through the gas furnace 118. These furnace tubes act as a heating element for the indoor air being pushed out of the blower 116, over the furnace tubes, and into the ducts 114. However, the gas furnace 118 is generally operated when robust heating is desired. During conventional heating and cooling operations, air from the blower 116 is routed over an indoor heat exchanger 120 and into the ductwork 114. The blower 116, the gas furnace 118, and the indoor heat exchanger 120 may be packaged as an integrated air handler unit, or those components may be modular. In other embodiments, the positions of the gas furnace 118, the indoor heat exchanger 120, and the blower 116 can be reversed or rearranged.

In at least one embodiment, the indoor heat exchanger 120 acts as a heating or cooling means that add or removes heat from the structure, respectively, by manipulating the pressure and flow of refrigerant circulating within and between the indoor and outdoor units via refrigerant lines 122. In another embodiment, the refrigerant could be circulated to only cool (i.e., extract heat from) the structure, with heating provided independently by another source, such as, but not limited to, the gas furnace 118. In other embodiments, there may be no heating of any kind, HVAC systems 100 that use refrigerant to both heat and cool the structure 102 are often described as heat pumps, while HVAC systems 100 that use refrigerant only for cooling are commonly described as air conditioners.

Whatever the state of the indoor heat exchanger 120 (i.e., absorbing or releasing heat), the outdoor heat exchanger 124 is in the opposite state. More specifically, if heating is desired, the illustrated indoor heat exchanger 120 acts as a condenser, aiding transition of the refrigerant from a high-pressure gas to a high-pressure liquid and releasing heat in the process. The outdoor heat exchanger 124 acts as an evaporator, aiding transition of the refrigerant from a low-pressure liquid to a low-pressure gas, thereby absorbing heat from the outdoor environment. If cooling is desired, the outdoor unit 104 has flow control devices 126 that reverse the refrigerant flow, allowing the outdoor heat exchanger 124 to act as a condenser and allowing the indoor heat exchanger 120 to act as an evaporator. The flow control devices 126 may also act as an expander to reduce the pressure of the refrigerant flowing therethrough. In other embodiments, the expander may be a separate device located in either the outdoor unit 104 or the indoor unit 106. To facilitate the exchange of heat between the ambient indoor air and the outdoor environment in the described HVAC system 100, the respective heat exchangers 120, 124 have tubing that winds or coils through heat-exchange surfaces, to increase the surface area of contact between the tubing and the surrounding air or environment.

The illustrated outdoor unit 104 may also include an accumulator 128 that helps prevent liquid refrigerant from reaching the inlet of a compressor 130. The outdoor unit 104 may include a receiver 132 that helps to maintain sufficient refrigerant charge distribution in the HVAC system 100. The size of these components is often defined by the amount of refrigerant employed by the HVAC system 100.

The compressor 130 receives low-pressure gas refrigerant either from the indoor heat exchanger 120 if cooling is desired or from the outdoor heat exchanger 124 if heating is desired. The compressor 130 then compresses the gas refrigerant to a higher pressure based on a compressor volume ratio, namely the ratio of a discharge volume, the volume of gas outputted from the compressor 130 once compressed, to a suction volume, the volume of gas inputted into the compressor 130 before compression, and environmental conditions. In the illustrated embodiment, the compressor is a multi-stage compressor 130 that can transition between at least a two volume ratios depending on whether heating or cooling is desired. In other embodiments, the HVAC system 100 may be configured to only cool or only heat, and the compressor 130 may be a single stage compressor having only a single volume ratio. Alternatively, the compressor could be a variable volume ratio compressor.

Figure 2:
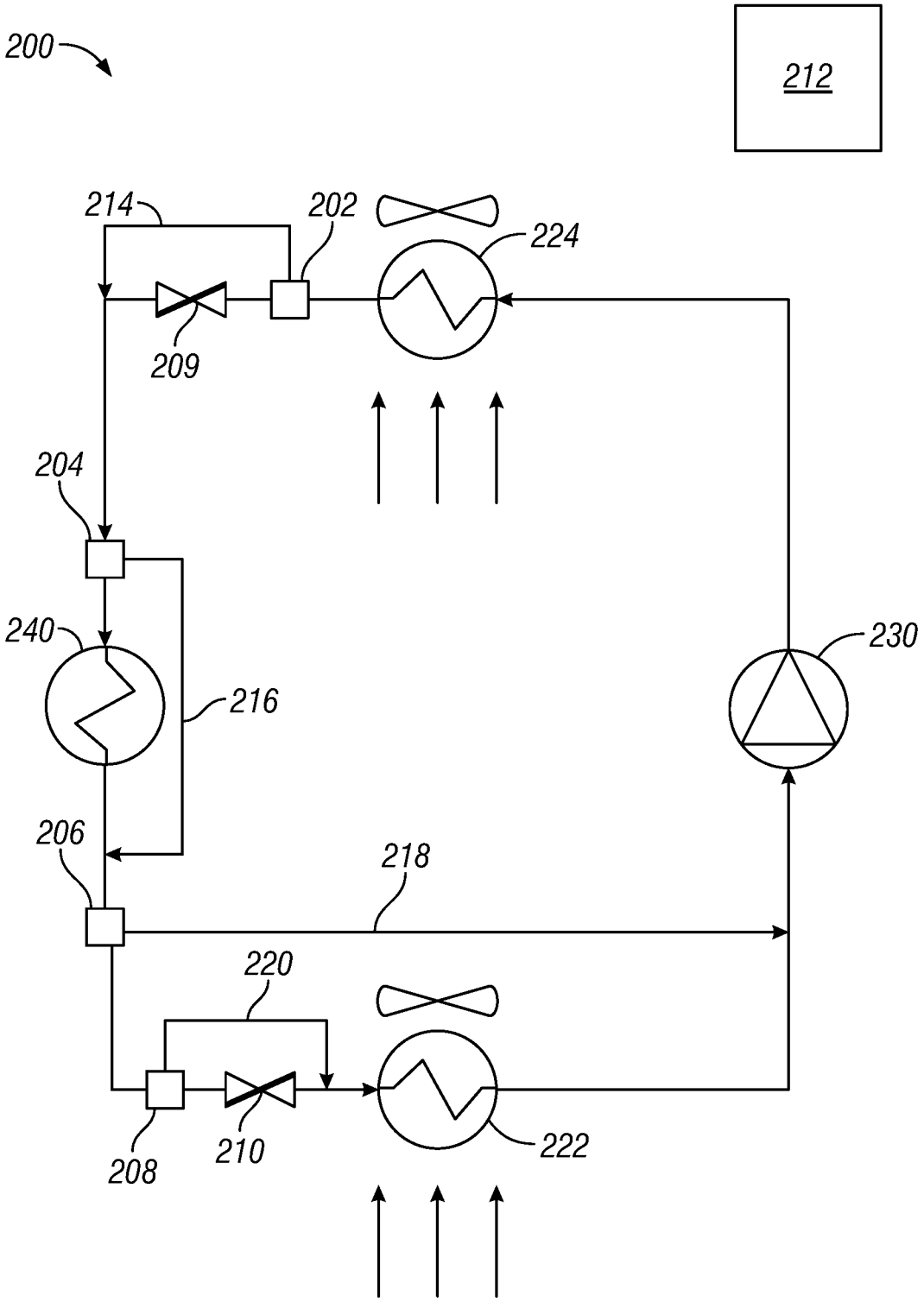
FIG. 2 is a block diagram of an HVAC system, according to one or more embodiments.
Figure 3A:
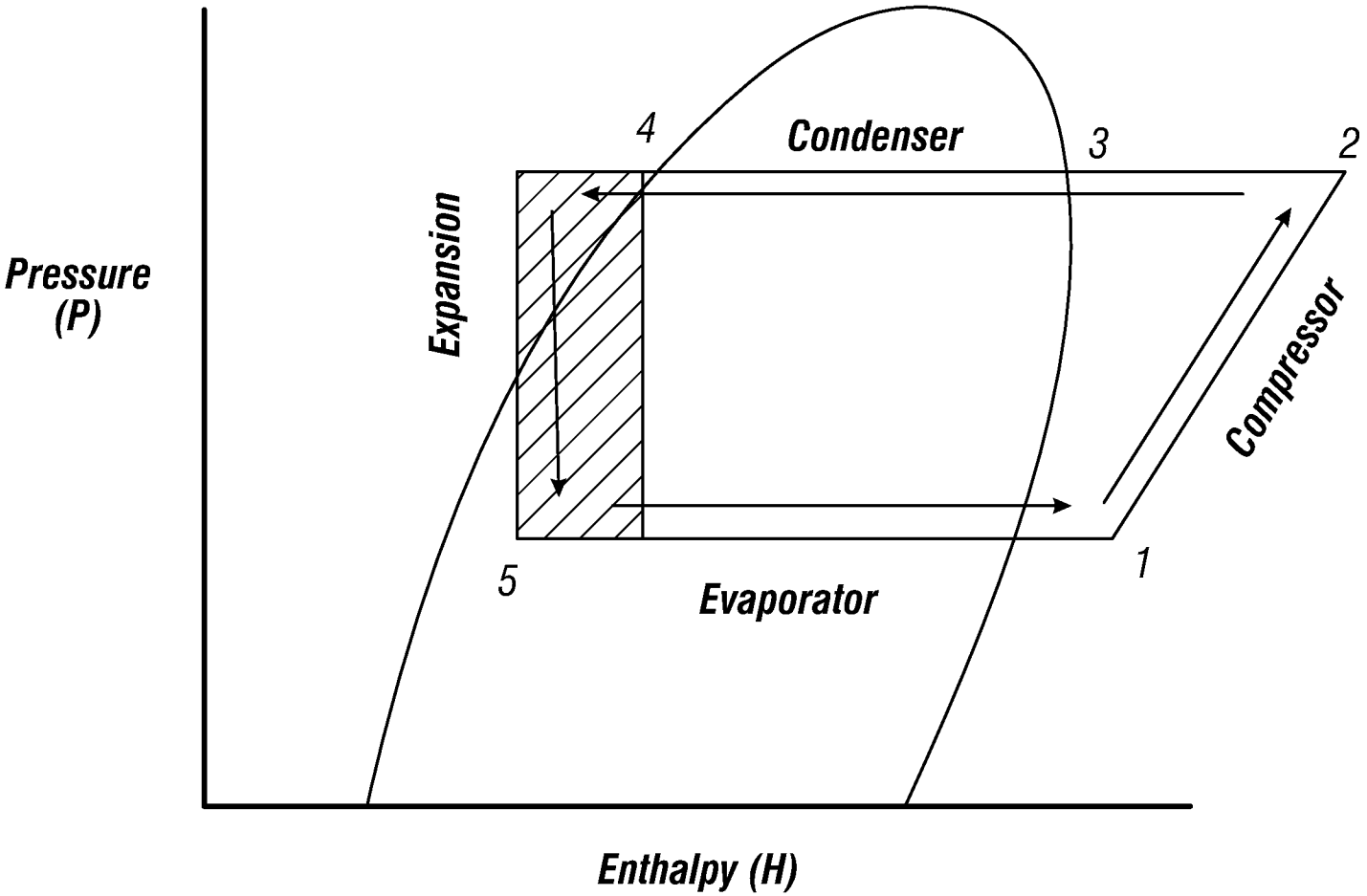
FIGS. 3A and 3B are pressure enthalpy graphs illustrating refrigeration cycles of the HVAC system shown in FIG. 2.
Figure 3B:
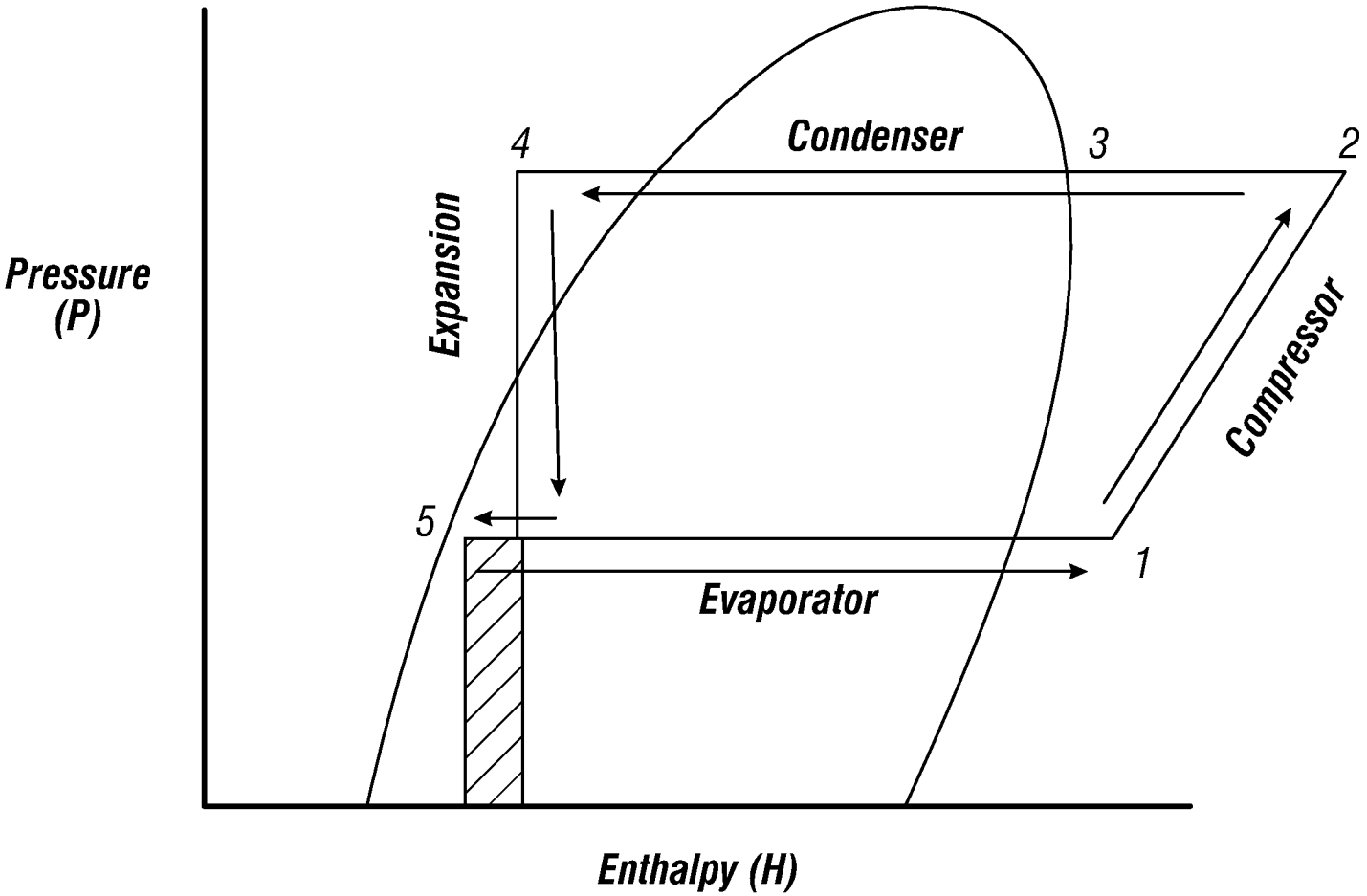

Referring now to FIGS. 2, 3A, and 3B, FIG. 2 is a simplified block diagram of an HVAC system 200. The HVAC system 200 includes a compressor 230, an outdoor heat exchanger or condenser 224, a first control valve 202, a first ("TESD") expansion device 209, a second control valve 204, a thermal energy storage device ("TESD") 240, a third control valve 206, a fourth control valve 208, a second (evaporator) expansion device 210, an indoor heat exchanger or evaporator 222, and a control system 212. The control system 212 (described below) is in electronic (wired or wireless) communication with the compressor 230, the control valves 202, 204, 206, 208 and the expansion devices 209, 210 and is programmed to select between multiple operation modes based on the load on the HVAC system 200 and/or user input as described below.

The HVAC system 200 may also include the equipment shown in FIG. 1 and function as discussed above with reference to FIG. 1. Accordingly, the function of the condenser 224, the expansion devices 209, 210, the evaporator 222, and the compressor 230 will not be discussed in detail except as necessary for the understanding of the HVAC system 200 shown in FIG. 2.

In a full charging mode, used typically during off-peak load times, the control system 212 is programmed to operate the compressor 230 to compress the refrigerant into a vapor refrigerant that flows through the condenser 224, where the refrigerant is condensed into high-pressure liquid refrigerant. As shown schematically, an optional fan may be used to direct airflow, indicated by arrows, over the condenser 224 to make the operation of condensing the refrigerant more efficient. The control system 212 is programmed to control the flow of refrigerant by controlling the operation of the compressor 230 and the other components based on the load on the HVAC system 200 and environmental conditions.

The control system 212 is also programmed to operate the first control valve 202 to allow the high-pressure liquid refrigerant to enter the TESD expansion device 209, which may be a variable expansion device and is adjusted by the control system 212 to expand and decrease the pressure of the refrigerant. The refrigerant then flows through the TESD 240, which includes a flow path through a thermal energy storage media within the TESD 240. The thermal storage media may be any suitable media for storing and discharging thermal energy over a period of time, such as for example water, glycol, or eutectic material. Flowing the refrigerant through the TESD 240 charges the TESD 240 with thermal energy by the refrigerant absorbing heat from the TESD 240 through a heat exchange process. The heat exchange process results in lowering the temperature of the media in the TESD 240, and evaporating the refrigerant. The amount of thermal energy absorbed by the TESD 240 can also be controlled by adjusting the expansion device 209. Further, depending on the storage media used, the storage media may undergo a phase change (e.g., gas to liquid or liquid to solid) as the media is cooled. The amount of charging of the media in the TESD 240 depends on the overall capacity of the HVAC system 200 and the anticipated cooling loads on the system.

The control system 212 is also programmed to operate the second control valve 204 such that at least a portion of the refrigerant flows through a bypass flow path 216, thereby bypassing and not flowing through the TESD 240. This allows refrigerant to flow through the system 200 should the TESD 240 be fully charged, or not need to be charged much further at that time, or if some of the refrigerant is needed to satisfy the conditioned space cooling requirements.

The control system 212 is also programmed to operate the third control valve 206 such that the low-pressure refrigerant flows through a bypass flow path 218, thereby bypassing and not flowing through the evaporator 222. The low-pressure refrigerant then re-enters the compressor 230 where the refrigerant is again compressed into high-pressure refrigerant, and the cycle is repeated. Alternatively, the third control valve 206 can be operated to allow some or all of the low-pressure refrigerant to flow through the evaporator 222. Doing so may involve the control system 212 operating the fourth control valve 208 such that the refrigerant flows through a bypass flow path 220 to bypass the second expansion device 210 before entering the evaporator 222. Alternatively, the expansion device 210 may be engaged, if charging of the TESD 240 is occurring at a higher temperature level and operation of the evaporator 222 is processed at a different lower temperature level.

In a full discharge mode, as shown in FIG. 2 and illustrated in FIGS. 3A and 3B and used typically during higher load or peak load times, the control system 212 is programmed to operate the compressor 230 to compress the refrigerant into a vapor refrigerant that flows through the condenser 224, where the refrigerant is condensed into high-pressure liquid refrigerant. The control system 212 is also programmed to operate the first control valve 202 such that the high-pressure liquid refrigerant flows through a bypass flow path 214, thereby bypassing the TESD expansion device 209 and remaining a high-pressure liquid. The bypass flow path 214 need only be used when the TESD expansion device cannot be fully open to minimize the refrigerant flow restriction, although typically during higher thermal loads on the system 200 the TESD expansion device 209 is fully open and the bypass flow path 214 need not be used. Next, the refrigerant flows through the TESD 240 with the charged thermal energy storage media. The storage media being charged with thermal energy absorbs heat from the refrigerant, thereby subcooling the refrigerant as shown in the shaded portion of FIG. 3A. As shown in FIG. 3A, the shaded portion depicts an additional refrigeration effect provided by the TESD 240 and resulted from a refrigeration cycle where the thermal storage media was previously subcooled to a temperature that is above or approximately at the evaporation temperature for the refrigerant in the evaporator 222 and ensures that the refrigerant is in liquid form when entering expansion leading to point 5 in the cycle. Alternatively, as shown in FIG. 3B, the shaded portion depicts a refrigeration cycle where the storage media was previously subcooled to a temperature below the evaporation temperature for the refrigerant in the evaporator 222, thus allowing a lower enthalpy prior to entering the evaporator 222 and thus improving the evaporation process and performance of the HVAC system 200. In such a situation, the TESD expansion device 209 may be used in the process. Regardless of whether the TESD 240 was cooled below or above the evaporation temperature, subcooling the refrigerant increases the cooling capacity of the HVAC system 200 as compared to not using the TESD 240 by allowing a higher ratio of heat absorption in the further stages of the cycle discussed below. The amount of refrigerant flowing through the TESD 240, and thus the amount of subcooling, depends on the overall load demands on the HVAC system 200 and environmental conditions. Further, as mentioned above, performance is the heating or cooling capacity provided by the HVAC system 200 per unit of power consumption. Examples include EER (energy efficiency ratio) in cooling and COP (coefficient of performance) in heating.

The control system 212 is also programmed to operate the second control valve 204 such that the refrigerant flows through a bypass flow path 216, thereby bypassing the TESD 240. Alternatively, the control system 212 can control the second control valve 204 to allow some refrigerant to flow through the TESD 240 and some refrigerant to bypass the TESD 240. In this way, the amount of subcooling of the refrigerant can be controlled during discharging by controlling the amount of refrigerant flowing through the TESD 240.

The control system 212 is also programmed to operate the third and fourth control valves 206 and 208 to allow all of the subcooled refrigerant to enter the second expansion device 210, where the subcooled refrigerant is expanded into low-pressure liquid refrigerant. As noted above, the refrigerant being subcooled further enables the second expansion device 210 to work more efficiently due to all of the refrigerant being in a liquid form. The low-pressure liquid refrigerant then enters the evaporator 222, where it is evaporated into low-pressure vapor refrigerant. The low-pressure vapor refrigerant then enters the compressor 230, where it is compressed into a high-pressure vapor refrigerant, and the cycle is repeated.

In a part-load mode, as shown in FIG. 2 and used typically during off-peak load times, the control system 212 is programmed to operate the components of the system such that the TESD 240 may be charged alternately or in conjunction with providing the part-load cooling capacity to condition the space. In part-load mode, at least some of the refrigerant may flow through the TESD 240 and through the evaporator 222. Use of the bypass flow paths and expansion devices 209 and 210 in part-load mode depends on the load on the system 200 and environmental conditions. However, to charge the TESD 240, there is more energy absorbed by the TESD 204 than discharged. Once again, charging of the TESD 240 can occur at the same temperature level as the operation of the evaporator 222, or alternatively it can occur at different temperatures. As described above, this would be controlled by the expansion devices 209 and 210 working in conjunction with one another.

Discharging the thermal energy from the TESD 240 and further subcooling the refrigerant improves the performance of the entire HVAC system 200 by making the refrigeration cycle more efficient. A more efficient cycle reduces the stress on the power grid, lowers electricity cost, and allows the HVAC system 200 to be downsized. Usage of the TESD 240 may also have other advantages, such as boosting dehumidification, extending the operational envelope of the HVAC system 200, reducing compressor discharge temperature, and improving system reliability. Another advantage of the TESD 240 is that the TESD 240 can be charged at a different time than when the TESD 240 is discharged, such as when there is no cooling load on the HVAC system 200 or when electricity supply is at a lower cost. The TESD 240 may then be discharged during a higher load demand or higher electricity cost hours to lower the operating cost of the HVAC system 200. Another potential benefit is an extra cooling capacity provided by TESD 240 during a pulldown operation. Further, although not shown in detail, the TESD 240 may also be discharged to cool down the control system 212 or other electronics.

It should also be appreciated that the HVAC system 200 may be one circuit in a multi-circuit system, some of which may also have TESDs and some of which may not. Further, the circuits with TESDs need not operate synchronously. One circuit may be operating in one mode, such as charging a TESD, while another circuit is discharging a TESD or in a conventional cooling mode.

Figure 4:
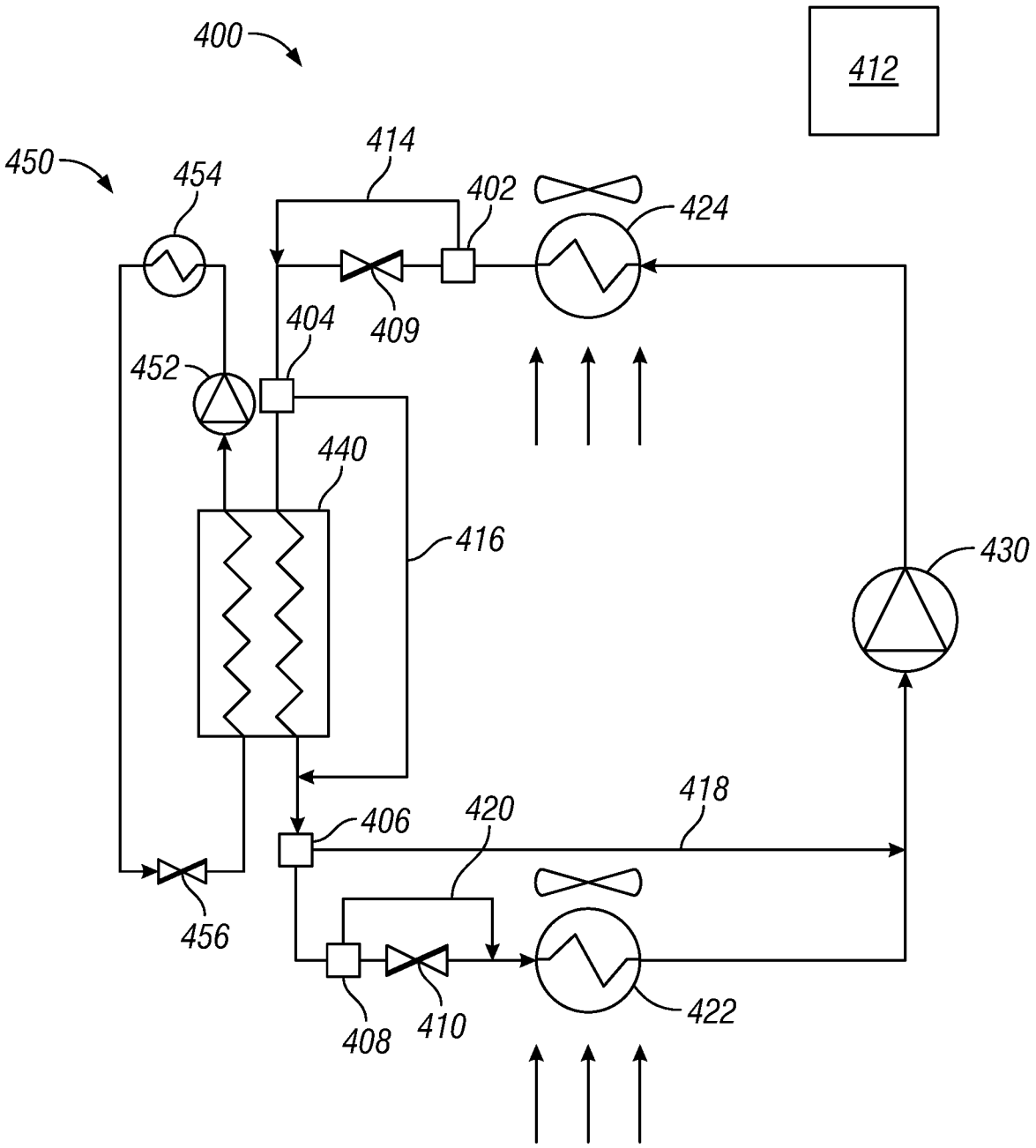
FIG. 4 is a block diagram of an HVAC system, according to one or more embodiments.

Referring now to FIG. 4, FIG. 4 is a simplified block diagram of another embodiment of an HVAC system 400. The HVAC system 400 includes a compressor 430, an outdoor heat exchanger or condenser 424, a first control valve 402, a first ("TESD") expansion device 409, a second control valve 404, a TESD 440, a third control valve 406, a fourth control valve 408, a second (evaporator) expansion device 410, an indoor heat exchanger or evaporator 422, and a control system 412. The control system 412 is in electronic (wired or wireless) communication with the compressor 430, the control valves 402, 404, 406, 408 and the expansion devices 409, 410 and is programmed to select between multiple operation modes based on the load on the HVAC system 400, environmental conditions and/or user input as described below.

The HVAC system 400 is similar to the HVAC system 200 is that the TESD 440 is charged and discharged with thermal energy to further subcool the refrigerant in the HVAC system 400. Similar elements in the HVAC system 400 are given similar reference numbers and so further explanation of their operation will not be discussed. However, unlike the HVAC system 200, there need not be two distinct charging and discharging modes because a separate charging system or secondary cooling circuit 450 charges the TESD 440. In charging the TESD 440, typically during off-peak load times, the control system 412 is programmed to operate a charging compressor 452 to compress a refrigerant in the charging system 450 into a vapor refrigerant that flows through a charging outdoor heat exchanger or charging condenser 454, where the refrigerant is condensed into high-pressure liquid refrigerant. The control system 412 is programmed to control the flow of refrigerant by controlling the operation of the compressor 452 and the other components of the charging circuit based on the load on the HVAC system 400 and environmental conditions.

The refrigerant then flows through a charging expansion device 456, where the charging refrigerant is expanded into low-pressure predominantly liquid refrigerant. The low-pressure predominantly liquid refrigerant then enters the TESD 440 in a flow path through thermal energy storage media within the TESD 440. The thermal storage media may be any suitable media for storing and discharging thermal energy over a period of time, such as for example water, glycol, or eutectic material. Flowing the charging refrigerant through the TESD 440 charges the TESD 440 with thermal energy by the refrigerant absorbing heat from the TESD 440 through a heat exchange process resulting in lowering the temperature of the media in the TESD 440, lowering the pressure of the refrigerant, and evaporating the charging refrigerant. The amount of charging of the media in the TESD 440 depends on the overall capacity of the charging system 450 and the anticipated cooling loads on the main HVAC system 400. The low-pressure vapor refrigerant then enters the compressor 452, where it is compressed into a high-pressure vapor refrigerant, and the cycle can be repeated.

In a discharge mode, used typically during higher load or peak load times, the control system 412 is programmed to operate the compressor 430 to compress the refrigerant into a high-pressure vapor refrigerant that flows through the condenser 424, where the refrigerant is condensed into high-pressure liquid refrigerant. The high-pressure liquid refrigerant then flows through the TESD 440 with the charged thermal energy storage media. The storage media being charged with thermal energy absorbs heat from the refrigerant, thereby further subcooling the refrigerant to improve performance as previously discussed with respect to FIGS. 2, 3A, and 3B. Subcooling the refrigerant increases the cooling capacity of the HVAC system 400 as compared to not using the TESD 440 by allowing a higher ratio of heat absorption in the further stages of the cycle discussed below. The amount of refrigerant flowing through the TESD 440, and thus the amount of subcooling, depends of the overall load demands on the HVAC system 400 and environmental conditions.

The subcooled refrigerant then enters the second expansion device 410, where the subcooled refrigerant is expanded into low-pressure predominantly liquid refrigerant. As noted above, the refrigerant being subcooled enables the second expansion device 410 to work more efficiently due to all of the refrigerant being in liquid form. The low-pressure liquid refrigerant then enters the evaporator 422, where it is evaporated into low-pressure vapor refrigerant. The low-pressure vapor refrigerant then enters the compressor 430, where it is compressed into compressed vapor refrigerant, and the cycle is repeated.

Figure 5:
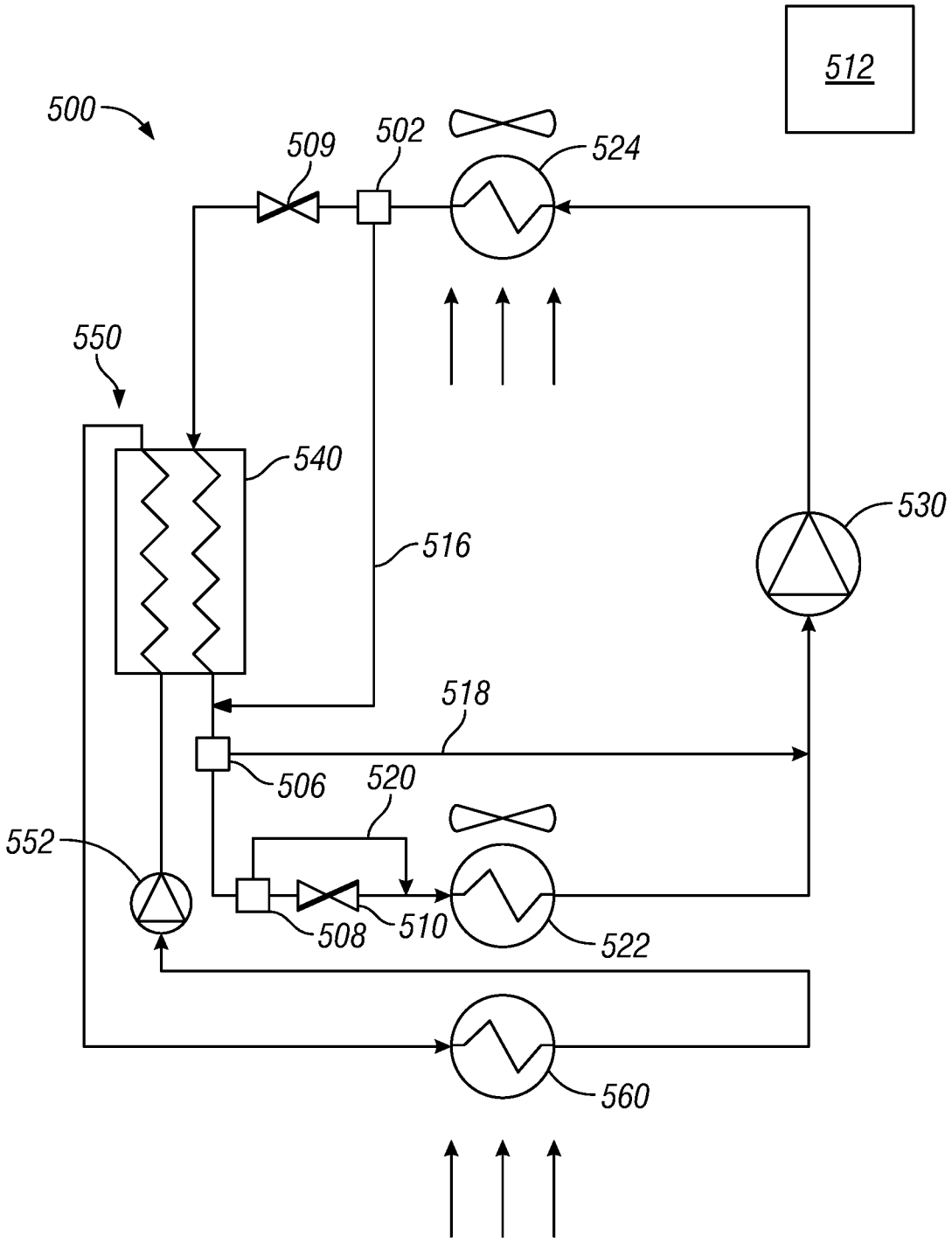
FIG. 5 is a block diagram of an HVAC system, according to one or more embodiments.

Referring now to FIG. 5, FIG. 5 is a simplified block diagram of another embodiment of an HVAC system 500. The HVAC system 500 includes a compressor 530, an outdoor heat exchanger or condenser 524, a first control valve 502, a first ("TESD") expansion device 509, a TESD 540, a second control valve 506, a third control valve 508, a second (evaporator) expansion device 510, an indoor heat exchanger or evaporator 522, and a control system 512. The control system 512 is in electronic (wired or wireless) communication with the compressor 530, the control valves 502, 506, 508, and the expansion devices 509, 510 and is programmed to select between multiple operation modes based on the load on the HVAC system 500 and/or user input as described below. The HVAC system 500 also includes a cooling circuit 550 separate from the refrigeration circuit, the components and operation of which is described below.

In a charging mode, used typically during off-peak load times, the control system 512 is programmed to operate the compressor 530 to compress the refrigerant into a high-pressure vapor refrigerant that flows through the condenser 524, where the refrigerant is condensed into high-pressure liquid refrigerant. The control system 512 is programmed to control the refrigerant flow by controlling the operation of the compressor 530 and the other components based on the load on the HVAC system 500 and environmental conditions.

The control system 512 is also programmed to operate the first control valve 502 to allow the high-pressure liquid refrigerant to enter the TESD expansion device 509, which may be a variable expansion device and is adjusted by the control system 512 to expand and decrease the pressure in the refrigerant. The refrigerant then flows through the TESD 540, which includes a flow path through a thermal energy storage media within the TESD 540. Flowing the refrigerant through the TESD 540 charges the TESD 540 with thermal energy by the refrigerant absorbing heat from the TESD 540 through a heat exchange process resulting in lowering the temperature of the media in the TESD 540, lowering the pressure of the refrigerant, and evaporating some or all of the refrigerant. The amount of charging of the media in the TESD 540 depends on the overall capacity of the HVAC system 500, the anticipated cooling loads on the system and environmental conditions.

The control system 512 is also programmed to operate the second control valve 506 such that at least a portion of the low-pressure refrigerant flows through a bypass flow path 518, thereby bypassing and not flowing through the evaporator 522. The low-pressure refrigerant then re-enters the compressor 530 where the refrigerant is again compressed into a high-pressure refrigerant, and the cycle is repeated. As described above, the charging of the TESD 540 can be provided individually or in conjunction with the part-load operation of the evaporator 522.

Figure 6:
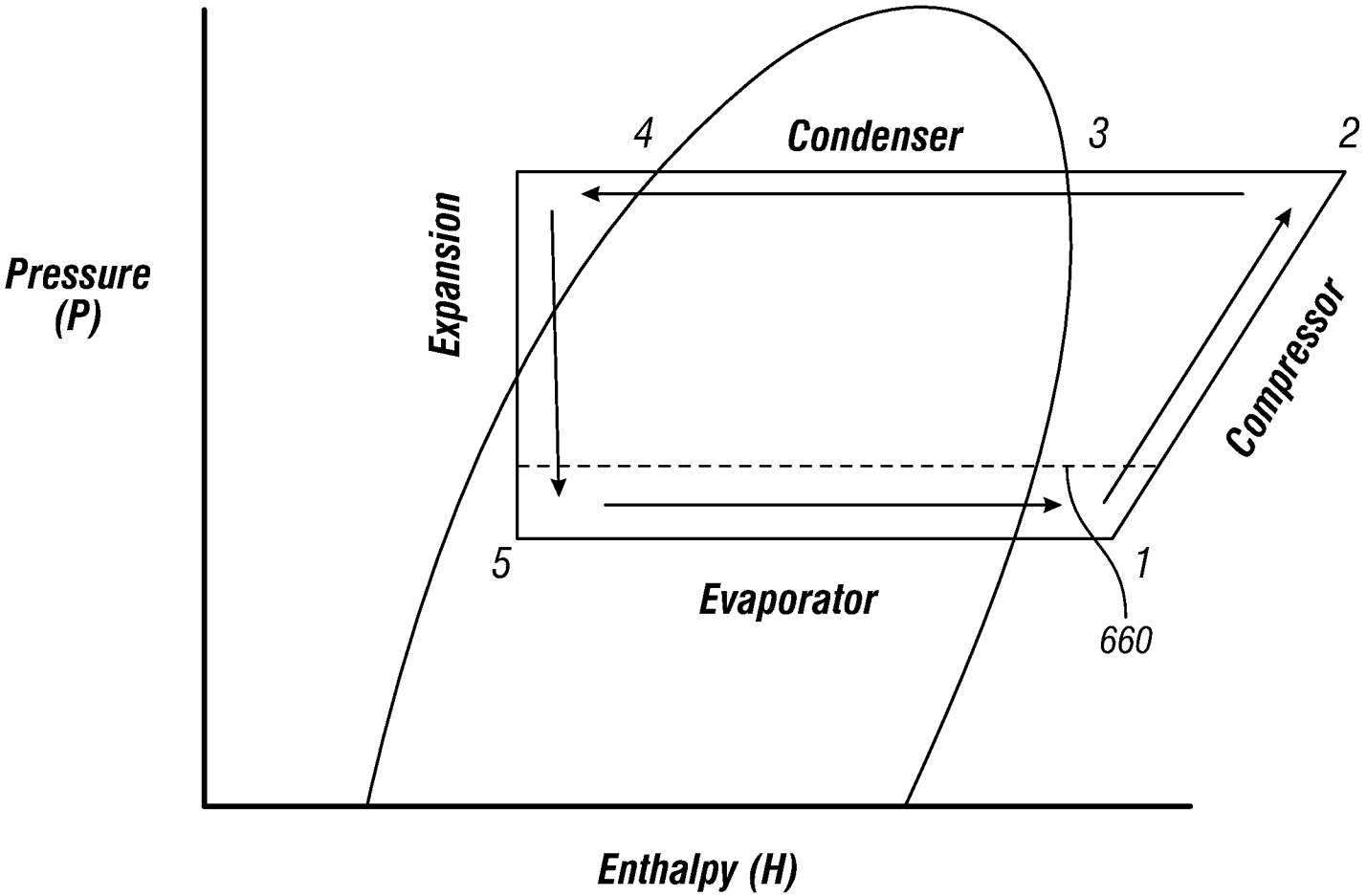
FIG. 6 is a pressure enthalpy graph illustrating a refrigeration cycle.

In a discharge mode, as shown in FIG. 5 and illustrated in FIG. 6 and used typically during higher load or peak load times, the control system 512 is programmed to operate the compressor 530 to compress the refrigerant into a high-pressure vapor refrigerant that flows through the condenser 524, where the refrigerant is condensed into a high-pressure liquid refrigerant.

The control system 512 is also programmed to operate the first control valve 502 such that at least a portion of the high-pressure liquid refrigerant flows through a bypass flow path 516, thereby bypassing the TESD expansion device 509 and the TESD 540 and remaining a high-pressure liquid.

The control system 512 is also programmed to operate the second control valve 506 to allow the refrigerant to enter the second expansion device 510, where the refrigerant is expanded into low-pressure liquid refrigerant. Should the second expansion device not be needed, the control system 512 may also control the third control valve 508 to direct the refrigerant to bypass the second expansion device 510 by flowing through a bypass flow path 520. The low-pressure liquid refrigerant then enters the evaporator 522, where it is evaporated into low-pressure vapor refrigerant. The low-pressure vapor refrigerant then enters the compressor 530, where it is compressed into a high-pressure vapor refrigerant, and the cycle is repeated.

Also during discharge mode, the control system 512 is programmed to operate a cooling pump 552 to flow a cooling fluid through the cooling circuit 550. Cooling fluid leaving the pump 552 flows through the TESD 540 with the charged thermal energy storage media. The storage media being charged with thermal energy absorbs heat from the fluid, thereby cooling the fluid in the cooling circuit 550. The cooling fluid then flows to a heat exchanger 560 that is positioned upstream of the evaporator 522 with respect to the airflow to adjust the temperature of the air flowing over the evaporator 522. Cooling the cooling fluid and thus preconditioning the air flowing over the evaporator 522 increases the cooling capacity of the HVAC system 500 as compared to not using the TESD 540. Precooling the airflow over the evaporator 522 allows the evaporator 522 to operate more efficiently and without the need to further lower the pressure of the refrigerant as shown by the dotted line 660 in FIG. 6. Not requiring as much expansion allows a higher rate of the heat absorption in the further stages of the cycle. The amount of cooling fluid flowing through the TESD 540, and thus the amount of the overall cooling capacity of the HVAC system 500, depends of the overall load demands on the HVAC system 500 and environmental conditions.

Figure 7:
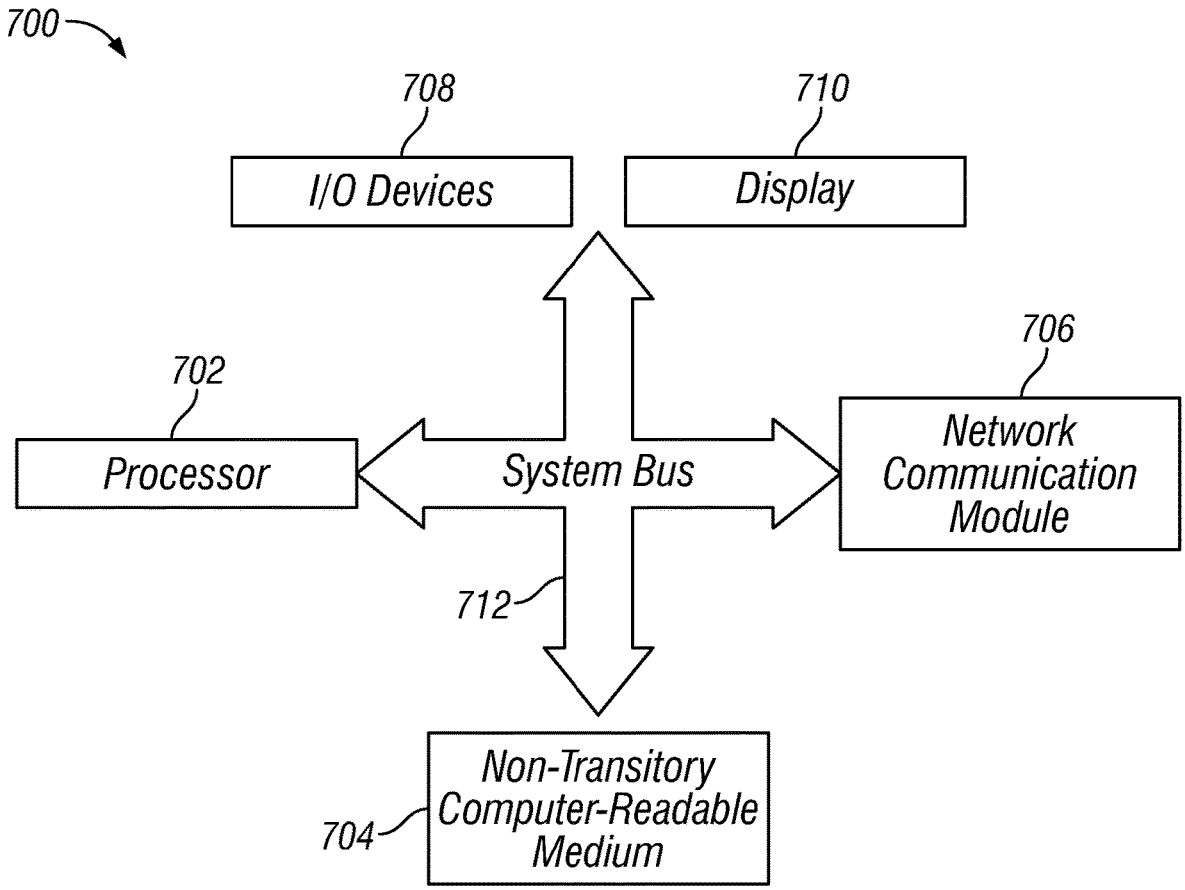
FIG. 7 is a block diagram of a control system, according to one or more embodiments.

FIG. 7 is a block diagram of a controller 700 that can be used in the control systems to control the HVAC systems as described above. The controller 700 includes at least one processor 702, a non-transitory computer readable medium 704, an optional network communication module 706, optional input/output devices 708, and an optional display 710 all interconnected via a system bus 712. In at least one embodiment, the input/output device 708 and the display 710 may be combined into a single device, such as a touch-screen display. Software instructions executable by the processor 702 for implementing software instructions stored within the controller 700 in accordance with the illustrative embodiments described herein, may be stored in the non-transitory computer readable medium 704 or some other non-transitory computer-readable medium.

Although not explicitly shown in FIG. 7, it will be recognized that the controller 700 may be connected to one or more public and/or private networks via appropriate network connections. It will also be recognized that software instructions may also be loaded into the non-transitory computer readable medium 704 from an appropriate storage media or via wired or wireless means.

It should be appreciated that each of the embodiment HVAC systems shown and described herein are configured for and may be operated under a standard cooling mode of a typical refrigeration cycle of compressor, condenser, expansion device, and evaporator.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. For example, certain embodiments disclosed here envisage usage with a powered fan rather than an inducer fan, or no fan at all. Moreover, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

What is claimed is:

1. A heating, ventilation, and air-conditioning ("HVAC") system for use with a refrigerant, the HVAC system comprising:

a refrigerant circuit comprising:

a compressor operable to compress the refrigerant;

a condenser positioned downstream of the compressor;

an evaporator positioned upstream of the compressor, the evaporator configured to vaporize the refrigerant flowing therethrough at an evaporation temperature;

a thermal energy storage device ("TESD") including thermal energy storage media and positioned in line between the condenser and the evaporator;

a TESD expansion device upstream of the TESD;

a TESD bypass flow path bypassing the TESD and the TESD expansion device;

an evaporator expansion device positioned downstream of the TESD and upstream of the evaporator;

an evaporator expansion device bypass flow path positioned downstream of the TESD and bypassing the evaporator expansion device while allowing flow through the evaporator;

an evaporator bypass flow path bypassing the evaporator expansion device and the evaporator;

a secondary cooling circuit separate from the refrigerant flow of the refrigerant circuit comprising:

a cooling pump operable to flow a cooling fluid through the secondary cooling circuit;

a cooling fluid flow path configured to allow flow of the cooling fluid from the cooling pump through the thermal energy storage media in the TESD; and a heat exchanger upstream of the evaporator with respect to airflow and configured to adjust a temperature of an air flowing over the evaporator; and a control system comprising a controller programmed to:

operate in a charging mode to flow all the refrigerant through the TESD expansion device to expand the refrigerant and through the TESD to charge the TESD with thermal energy and cool the TESD and flow at least a portion of the refrigerant through the evaporator bypass flow path; and operate in a discharge mode to flow at least a portion of the refrigerant through the TESD bypass flow path and through the evaporator and also control operation of the cooling pump to flow the cooling fluid through the TESD to cool the cooling fluid and then through the heat exchanger such that the air flowing over the evaporator is precooled by the heat exchanger so as to improve the performance of the evaporator.

2. The HVAC system of claim 1, wherein in the discharge mode, the controller is programmed to control at least a portion of the refrigerant to flow through the evaporator expansion bypass flow path and through the evaporator.

3. The HVAC system of claim 1, wherein the performance of the evaporator is improved by allowing the evaporator to operate more efficiently and without the need to further lower the pressure of the refrigerant.

* * * * *